United States Patent [19]

Eickmann

[11] Patent Number: 4,904,167

[45] Date of Patent: Feb. 27, 1990

[54] MEMBRANES AND NEIGHBORING MEMBERS IN PUMPS, COMPRESSORS AND DEVICES

[76] Inventor: Karl Eickmann, 2420 Isshiki, Hayama-machi, Kanagwa-Ken, Japan

[21] Appl. No.: 146,929

[22] Filed: Jan. 22, 1988

[30] Foreign Application Priority Data

Feb. 26, 1987 [DE] Fed. Rep. of Germany ..... 3706188

[51] Int. Cl.[4] ..... F04B 43/06

[52] U.S. Cl. ..... 417/395; 92/100

[58] Field of Search ..... 417/395; 92/100, 103 M

[56] References Cited

U.S. PATENT DOCUMENTS

| | | | |
|---|---|---|---|
| 1,466,242 | 8/1923 | Neal | 92/100 |
| 2,959,131 | 11/1960 | Shoosmith | 417/395 X |
| 3,093,086 | 6/1963 | Altoz et al. | 417/395 X |
| 4,621,989 | 11/1986 | Burgert | 417/395 X |

FOREIGN PATENT DOCUMENTS

| | | | |
|---|---|---|---|
| 318501 | 6/1934 | Italy | 92/100 |
| 2088970 | 6/1982 | United Kingdom | 417/395 |

*Primary Examiner*—Leonard E. Smith

[57] ABSTRACT

Pumps for nonlubricating fluid can use membranes for the separation of different fluids. Suitable membranes can be used for pressures up to several thousand atmospheres in the fluids. Such membranes are, however, subjected to difficult problems like stresses in the material of the membrane, compression of the material of the membrane and the like. These problems prevented long life of the membranes or it restricted the membranes to such short strokes that the deliveries of the pumps were small at a given size and weight. The present invention improves the life time and the delivery capacities of membranes by creating most suitable configurations of the membranes and of the adjacent parts. Pumps or compressors for relative big delivery quantities, and also for high pressures up to several thousand atmospheres in cases of pumps, are thereby obtained.

6 Claims, 13 Drawing Sheets

1670
1671
38
39
1
37
91
35
1665
1666
1667
1668
1660
1661
1662
1663
1664
35
1669
52

MEMBRANES AND NEIGHBORING MEMBERS IN PUMPS, COMPRESSORS AND DEVICES

DESCRIPTION OF THE PRIOR ART

The most advanced and most closely related prior art may be present in the inventor's earlier, not yet published, following patent applications:

Germany P-37 11 633.9 of Apr. 07, 1987

Japan Sho 62-83112 of Apr. 06, 1987

U.S. Ser. No. 07-037910 of Apr. 08, 1987 and:

Europe 87105118.1 of Apr. 07, 1987, now published E-OS-0,285,685, publihed by the European patent office on Dec. 10th, 1988.

These applications describes many details and functions of high pressure pumps in excess of one thousand atomspheres. These descriptions apply partially also to the present patent application and similar members have equal referential numbers as in the mentioned earlier applications. The contents of the above mentioned applications in different countries are substantially equal, but appear in different languages.

SUMMARY OF THE INVENTION

The aim and object of the present invention is, to improve especially membrane pumps of the above defined prior art of inventor's devices towards bigger delivery quantity per given outer diameter of the membrane, to improve the reliablity, efficiency and life time of the membranes and the provision of suitable neighboring parts for prevention of break of membranes by meeting with unsuitable neighboring parts or portions.

These objects and aims of the invention are obtained and secured by the details which appear in the following description of the preferred embodiments of the invention and in the appended claims or in the claims which may be finally granted in the applied for patent.

DESCRIPTION OF THE PREFERRED EMBODIMENTS

Figure 1:
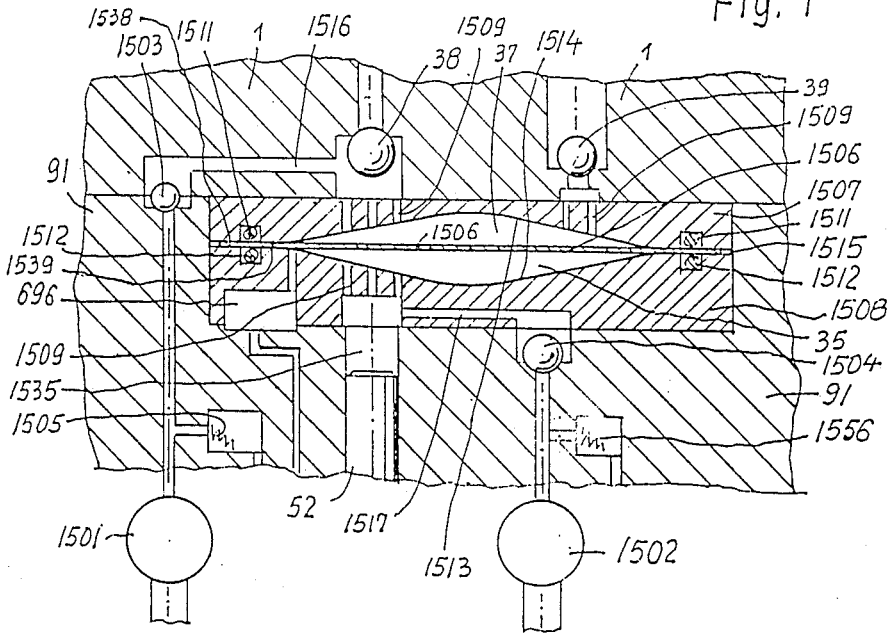
FIGS. 1, 4 to 17 and 24 to 27 illustrate longitudinal sectional views through portions of pumps of preferred embodiments of the invention.

In FIG. 1 a portion of a membrane pump of the invention is illustrated in a longitudinal sectional view. The pump is partially contained in housing portions 1 and 91 which are fastened together, for example, by bolts. The upper housing portion or head cover 1 contains the inlet valve(s) 38 and the outlet or delivery valve(s) 39. The bottom portion 91 of the housing contains the cylinder 1535 with the therein reciprocable piston 52. The piston 52 is driven to alternating intake and delivery strokes by a piston stroke drive means which is not shown in this figure, because it is either of a known conventional type or it is built in accordance with another figure of the present invention. Inserts 1507 and 1508 contain between the inserts the membrane 1506 and form above the membrane the inner chamber 37 and below the membrane the outer chamber 35. These chambers are provided in most of the embodiments of the invention and will in later figures no more become discussed. Instead of providing the membrane between the mentioned inserts, the membrane may also be provided between the housing portions 1 and 91. The inner chamber or second chamber 37 is communicated to the inlet and outlet valves, while the outer or first chamber 35 is communicated to the cylinder(s) and piston(s).

Thus, if the piston recicprocates, a first or lubricating, fluid is pumped periodically into the first chamber, while the second or non lubricating fluid is let over the inlet valve into the second or inner chamber at the downwards or inlet stroke of the piston, with the following upwards or delivery stroke of the piston pressing fluid aginst the membrane whereby the membrane compresses the second chamber and delivers the second or non lubricating fluid out of the exit- or outlet-valve.

So far the compressor or pump works similar in all embodiments of the present invention. These similar actions will not any more become described at the later figures because they are described at hand of FIG. 1, and in the mentioned earlier patent applications of the inventor.

FIG. 1 contains some more details for suitable operation and these details may be partially novel and thereby content of the present invention. For example, a prepressure pump 1501 supplies fluid over check valve 1503 and passages(s) 1516 into the second chamber to fill it with the required amount of fluid if such fluid is not entered through the inlet valve 38. A safety- or overload-valve 1505 may be or is applied to pump 1501 or to one of its communicating delivery passages. A second assistance or supply pump 1502 is or may be also applied to deliver fluid via check valve 1504 and passage(s) 1517 into the first or outer chamber 35 as far as such fluid is not supplied by piston(s) 52. A safety-, relief- or overload-valve 1556 is or may be applied to pump 1502 or to one of its delivery passages. Seals 1511 and 1512 may be set to seal the radial outer ends of the membrane 1506. membrane portions 1538 and 1539 are then formed radially inwards and outwards of the seals which may be inserted into respective seal ring grooves. Passages of small diameters may be set through the housing portions and/or through the inerts and such passages are shown by referentials 1509. They have small diameters and are plural passages in order to prevent entering of membrane portions under high pressure into passages. The diameters of these passages 1509 of the invention are smaller than the thickness of membrane 1506, if the pump is used for pressure in excess of one thousand atmospheres. Stopper faces 1513 and 1514 are formed above and above and below the membrane 1506 to limit the stroke of the membrane and also to form the axial ends of the respective first and second chambers (inner and outer chambers) 35 and 37. The configuration and dimension of the stopper faces 1513 and 1514 is of great importance in this present invention, as will be seen at the further description and technological analysis of the present invention. An outer space or clearance 1515 may be provided radially outside of the membrane 1506, for example, to permit radial contraction and expansion of the outer diameter of the membrane. A chamber portion 696 may be provided for the insertion of accessories or for use of containement or transfer of fluid. A passage may be provided to the mentioned chamber portion 696.

Figure 2:
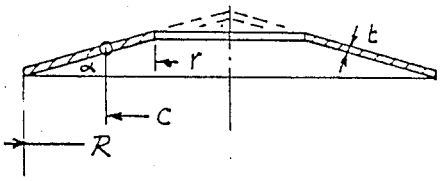
FIGS. 2, 3, and 18 to 23 are schematic figures which serve for an understanding of the geometric mathematical bases of the invention and are thereby geometric-mathematic explanatory figures.
Figure 3:
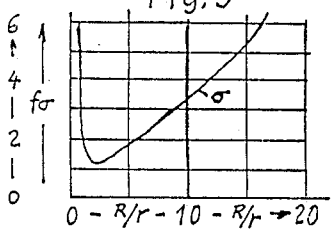

For an understanding of the present invention, attention is now given to FIGS. 2 and 3, which are figures for geometric-mathematic explanations and considerations. FIG. 2 is a longitudinal sectional view through a disc spring which is often called Belleville spring, named so, after its inventor. It has the outer radius R and the inner radius "r". Its thickness is "t" and it angle of inclination of its shanks is "phy". When the disc spring becomes axially compressed, its shanks swing around the swing center of radius "C".

The Eickmann equation (1) brings the delivery quantity "Q" of the $$Q = \frac{f}{R - r} \frac{\pi}{3} (R^3 - r^3) \quad (1)$$

spring of FIG. 2 at full axial compression and the Eickmann equation (2) brings the stresses which appear in the disc spring of FIG. 2 at the axial compression of this spring.

$$\sigma_{mqx} = \quad (2)$$

$$\approx \frac{G}{r}\left[\left(\frac{\frac{1}{\cos\phi} - 1}{1}\right)(R - G) \pm \frac{t}{2}\sin\phi\right]1.0989\,\frac{E}{r}$$

In these equations the following values apply:

Q=delivery quantity ($mm^3$/stroke)

f=stroke of axial compression (mm)

R=outer radius (mm)

r=inner radius (mm)

C=(R−r)/Ln (R/r)=center of swing (mm) with "Ln"="Loge".

t=thickness of spring (mm)

E=modulus of elasticity $kg/mm^2$ 1.0989=reciprocal of $0.91=(1-\nu^2)$ with "my"-=poisson's ratio for spring steel.

FIG. 3 shows the results for a stresses comparison factor over the ratio "R/r". One sees from FIG. 3 that the stresses very drasticly increase if the inner diameter becames very small relative to the outer diameter. The following table shows actually calculated data: (for spring steel)

TABLE 1

| | | for stroke = 1 mm: | | | | | |
|---|---|---|---|---|---|---|---|
| t mm | R mm | r mm | G mm | c− r mm | $\phi$ o | ΔL mm | $\sigma$ $Kg/mm^2$ |
| 0 | 30 | 15 | 21.64 | 6.64 | 3.81 | 0.0147 | 21.85 |
| " | " | 10 | 18.20 | 8.20 | 2.86 | 0.0102 | 21.42 |
| " | " | 8 | 16.64 | 8.64 | 2.60 | 0.0089 | 26.36 |
| " | " | 6 | 14.91 | 8.91 | 2.38 | 0.0077 | 27.06 |
| " | " | 5 | 13.95 | 8.95 | 2.29 | 0.0072 | 30.072 |
| " | " | 4 | 12.90 | 8.90 | 2.20 | 0.0066 | 34.65 |
| " | " | 1 | 8.52 | 7.52 | 1.97 | 0.00445 | 93.39 |
| " | " | 0.1 | 5.24 | 5.14 | 1.91 | 0.00287 | 603.52 |

From FIG. 3 and from the above table it is seen that the stresses become very high if the inner radius is very small relative to the outer radius and therefrom it can be concluded that the spring with relative smaller inner diameter will break due to heavy stresses. If the spring becomes a circular membrane without any inner bore, the membrane would break in the center due to the high stresses in the center and its neighborhood.

In the following tables the thickness of the spring is in addition considered and the following values will apply:

sigma I=stresses at inner bottom edge, sigma II=stresses at inner top edge, sigma III=stresses at outer bottom edge, Sigma OF=stresses in bows, and;

sigma W=stresses in cylindrical portions.

TABLE 2

| t mm | stroke mm | R mm | r mm | G mm | $\sigma$I $kg/mm^2$ | $\sigma$II $kg/mm^2$ | $\sigma$III $kg/mm^2$ | $\sigma$of $kg/mm^2$ | $\sigma$w $kg/mm^2$ | $\sigma$of + $\sigma$w $kg/mm^2$ | $\sigma$of − $\sigma$w $kg/mm^2$ |
|---|---|---|---|---|---|---|---|---|---|---|---|
| 0.5 | 1.5 | 30 | 15 | 21.64 | 89 | 13 | −51 | −79 | 46 | 125 | 33 |
| " | " | " | 6 | 14.91 | 127 | 7 | −34 | −48 | 61 | 109 | 13 |
| " | " | " | 5 | 13.95 | 143 | 5 | −33 | −46 | 67 | 114 | 21 |
| " | " | " | 1 | 8.53 | 530 | −66 | −32 | −40 | 211 | 251 | 171 |
| 7 | 1.5 | 30 | 15 | 21.64 | 128 | −26 | −70 | −156 | 46 | 202 | 110 |
| " | " | " | 6 | 14.91 | 187 | −53 | −46 | −95 | 61 | 156 | 34 |
| " | " | " | 5 | 13.95 | 212 | −64 | −45 | −91 | 67 | 159 | 24 |
| " | " | " | 1 | 8.53 | 829 | −364 | −42 | −78 | 211 | 289 | 133 |
| 0.1 | 1.5 | 30 | 15 | 21.64 | 58 | 43 | −35 | 16 | 46 | 62 | −30 |
| " | " | " | 6 | 14.91 | 79 | 55 | −25 | 9 | 61 | 71 | −52 |
| " | " | " | 5 | 13.95 | 88 | 60 | −24 | 9 | 67 | 77 | −58 |
| " | " | " | 1 | 8.53 | 292 | 172 | −24 | 8 | 211 | 219 | −203 |

From the calculated sample of this table 2 it is seen that the stresses increase very considerably, if the thickness of the spring increases.

It is understood that the invention deals with membranes but not with disc springs. The comparison with the above disc springs leads, however, to the impression that the stresses in the circular membrane of even thickness increases so much in the radial middle that the membrane might or must break because the stresses increase drasticly with increase of the thickness of the membrane. If, for example, in FIG. 2 the disc spring would become a membrane with "r=o" (membrane without a central bore), as indicated by the dotted lines in FIG. 2, the membrane would break in its center, namely in the top of the dotted lines in FIG. 2.

It is now an aim of this invention to increase the stroke and life time of the membrane by preventing the high stresses in the medial concentric portion of the membrane.

Figure 5:
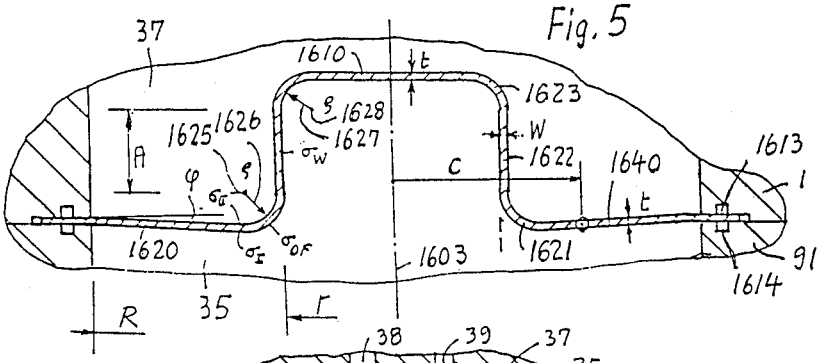

A first solution of this aim of the invention is given by the embodiment of FIG. 5. The radial outer portion 1620 of the membrane is radially inwardly extended until about R/r=about 2, namely to the radius of smallest stress. Instead of letting the membrane continue as usual, it is now provided with a bow of radius 1626 around the center-circle line 1625. From there extends a cylindrical portion 1622 to end in an additional bow 1623 with radius 1627 around the circular center line 1628. Therefrom extends a radially plane end portion 1610. The stresses sigma I, sigma II, sigma III, sigma OF and sigma W then occur at the places where they are shown in FIG. 5.

Comparing the FIG. 5 with the above table 2 it will be recognized that the membrane of FIG. 5 has smaller stresses at r=0.5R than a membrane of FIG. 2 would have in the medial center portion. Consequently, a membrane of the invention of FIG. 5 will obtain a longer life time, a longer stroke and a bigger delivery quantity "Q" than the common membrane of FIG. 2. In short, the membrane of FIG. 5 obtains the aim of the invention in appreciable extent.

On a first glimpse the impression may appear that the membrane should be made of highly flexible material, for example of a very thin sheet of gum, teflon, or the like.

At the actual testing, it has, however, been found that such soft materials seem to compress under several thousand atmospheres of pressure. Such compression seems to lead to exceed the range of plastic deformation. The so compressed portions of the membrane seem to get rid of the ability to return to their originally uncompressed shape and configuration. The formerly flat disc suffers a waved configuration.

The invention concludes therefrom for the present time that a membrane must have a big internal strength than the pressure applied onto its outer faces. For example, a membrane for 2000 atmospheres must be of a material of more than 20 kg per $mm^2$ strength of material. That means, that for membranes of more than 1000 atmospheres, the membranes should be made of strong metals, like spring steel or the non-corroding stainless spring steel, of aluminium bronze or the like.

Figure 4:
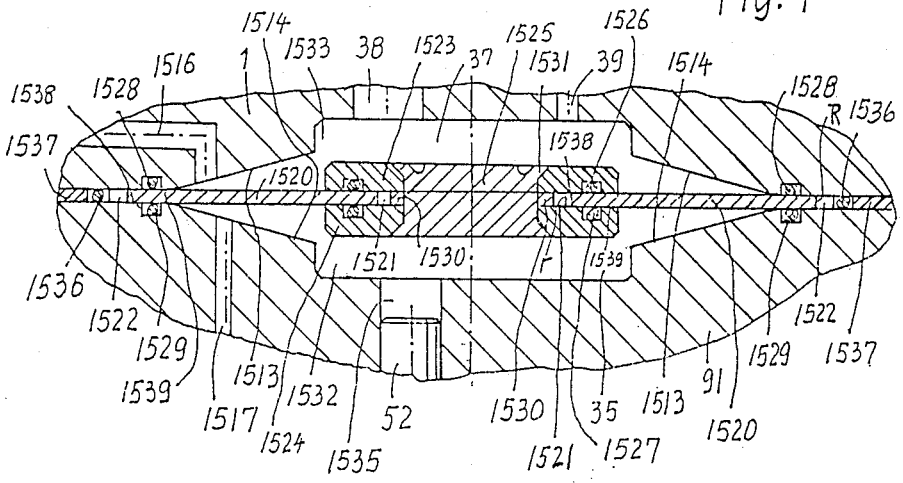

The next and very perfect solution for the aim of the invention is the embodiment which is shown in FIG. 4. Therein the membrane 1520 is provided by a flat disc spring like ring plate with outer radius "R" and inner radius "r". For lowest stresses "r" should be about equal to 0.5 R. The internal bore of the membrane is closed by bodies 1523 and 1524 which clamped together by the internal embrancement body 1526. Radial spaces 1522 and 1521 are provided radially of the membrane in order to give the radial inner and outer ends of the membrane the ability to compress and expand as a disc spring does. The stresses and strokes of such membranes can be exactly calculated in accordance with the book "mechanical springs" by Wahl, Mc. Graw Hill publishing company. The respective equations are:

$$\sigma = K_3 \frac{P}{t^2} \tag{3}$$

$$f = \text{stroke};$$

$$f = \frac{PR2}{K1\ Et3} \tag{4}$$

$$\text{with } K_3 = 0.3343 + \frac{1.242\ (R/r)^2 \log_e (R/r)}{(R/r)^2 - 1} \tag{5}$$

$$\text{and: } K_1 = \left[ 0.5514 . \frac{(R/r)^2 - 1}{(R/r)^2} + \frac{1.614\ (\log e[R/r])^2}{(R/r)^2 - 1} \right]^{-1} \tag{6}$$

Since this membrane 1520 of FIG. 4 has the ability to move radially with its radial ends during radial compression and expansion, it has the full flexibility of the disc spring with large strokes, small stresses and big deliver volume "Q". Insofar it is the ideal solution of the aim of the present invention. Its disadventage, however, is, that it requires the seals and bodies. The seals and bodies cost money. That, however, is still the smaller problem. The bigger problem is that seals are very difficult to handle for effective seal and life time at more than 500 atmospheres. The seals are shown in FIG. 4 by referentials 1526 to 1529. Seal seat portions or distance ring portions 1530 and 1537 are provided to define the axial distance of the body- and housing-faces. The mentioned distance rings are substantially of the same thickness as the membrane 1520, with the distance rings very slightly thicker if easy radial movement of the radial ends of the membrane between the adjacent faces is desired.

Figure 6:
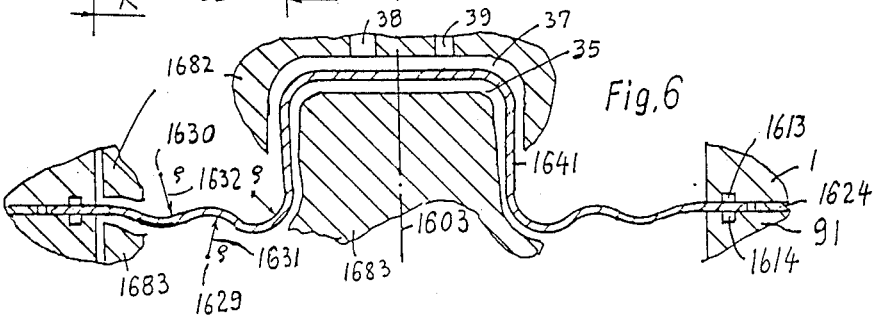

FIG. 6 illustrates that the embodiment of FIG. 5 may lead to still longer strokes and delivery quantities if bowed portions (wave portions) with radii 1631, 6132 around circular center lines 1629 and 1630 are provided on the radial outer portion 1620 of the membrane of FIG. 5. Shown in FIG. 6 is further, that in case of membranes of FIGS. 5 to 8 dead space filling bodies should be provided in the first and second, (outer and inner) chambers. The dead space fillers are shown by referentials 1682, 1683 and should be of a configuration to form the border faces of the chambers to act as stopper faces for the membrane. Portion 1641 of FIG. 6 corresponds to portion 1622 of FIG. 5.

Figure 7:
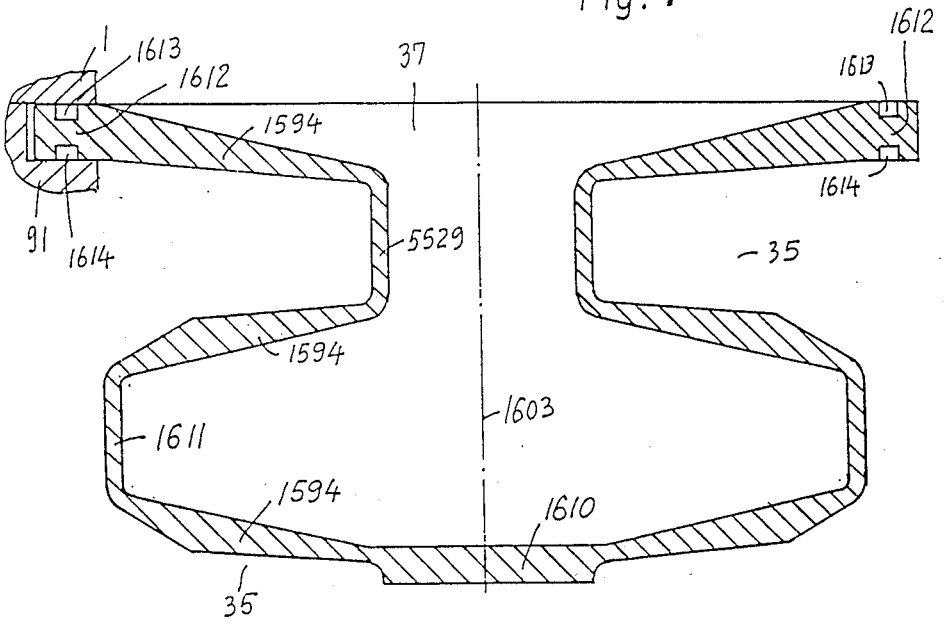

FIG. 7 is also a preferred embodiment of the invention for high delivery quantity of a membrane pump. This membrane consists of a single body with a fastening portion 1612, a therefrom extending disc spring like portion 1594 with a therefrom extending cylindrical portion 5529, a therefrom extending second disc spring like portion 1594, a therefrom extending second cylindrical portion 1611, a therefrom extending third disc spring like portion 1594 and a closing end portion 1610. Thus, in the Figure three disc spring like portions act together with two radially flexible cylindrical portions. At every stroke the axial deformations of the disc spring portions add to the radially deforming cylindrical portions to bring about together a big delivery quantity during a long axial stroke of the membrane.

Figure 8:
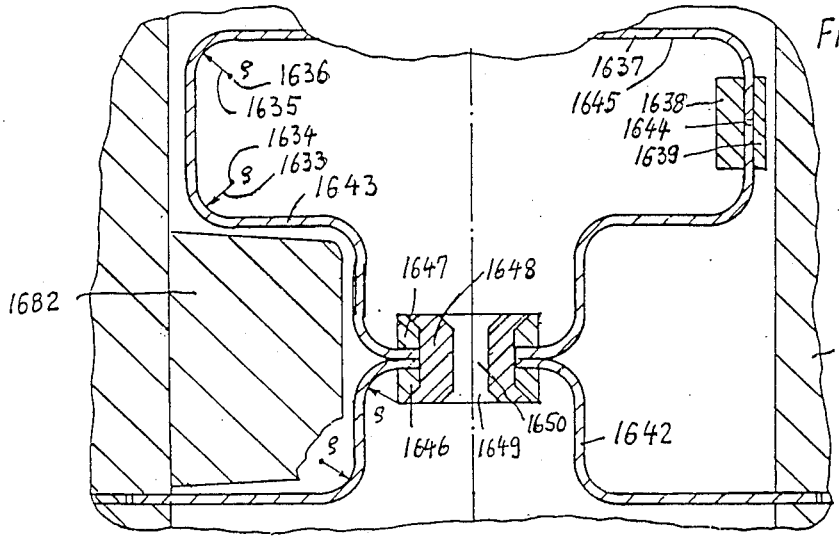

FIG. 8 then illustrates a further embodiment of the invention, which provides a possibility to assemble a plurality of the herebefore discussed membranes together to a singly acting membrane of very high delivery quantity. In this Figure radial ends of different membrane portions are fastened together by holding bodies 1646 and 1647 while the holding bodies are clampged together by the internal clamping body 1648. This body has a bore 1649 which forms a passage 1650 to communicate the chamber portions on both axial ends of the clamping arrangement. Axial ends of different membrane portions are clamped with their ends 1644 head to head by clamping bodies or holding bodies 1638 and 1639.

Figure 9:
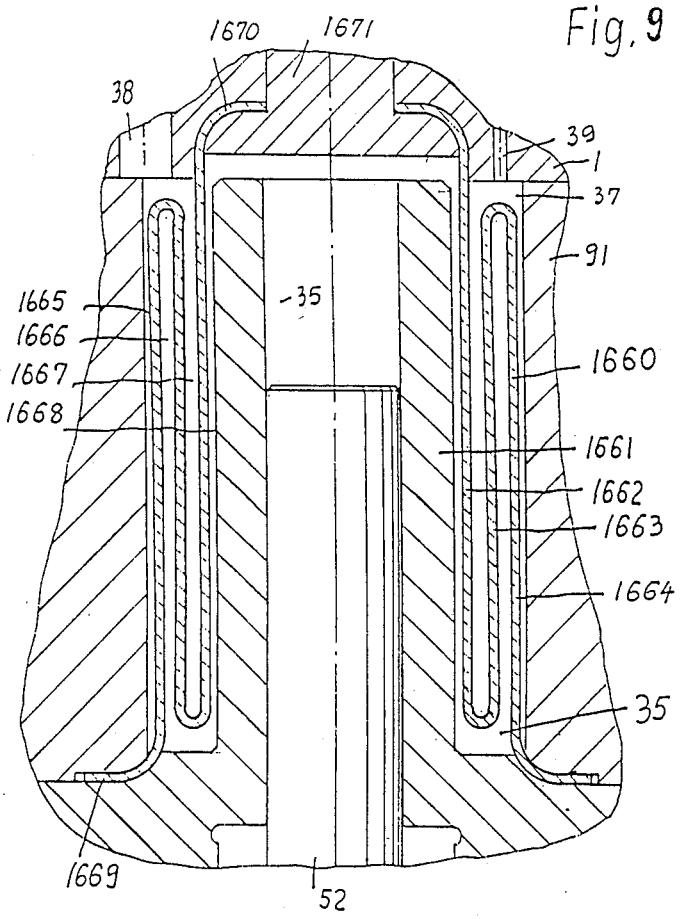

FIG. 9 illustrates another embodiment of a membrane of the invention for high delivery quantity. It is formed by a plurality of cylindrical pipe portions 1660, 1662 and 1663 which end and combine in bows on their axial ends, while the end 1669 of the radially outer portion is sealed and fastened to a wall or portion of the housing and the end of the radially innermost portion, namely end 1670, is fastened and sealed at another portion of a wall or housing. Piston 52 pumps into the outer chamber 35 and the membrane pumps into the inner chamber 37 with entrance and exit ports 38 and 39. A great feature of this embodiment is that the piston 52 has a very long guidance for good effective sealing and the chambers sorround the piston and the cylinder. A radially compact design is thereby managed and at the same time a big delivery quantity is obtained.

In this Figure and in the other Figures with cylindrically configurated membrane portions the following equations apply for the calculations of the radial deformations and of the internal stresses in the respective membrane portions:

$$\delta = [\,]\frac{pd}{E} \quad (7)$$

$$\text{and } \sigma = [\,]P \quad (8)$$

$$\text{with } [\,] = \frac{1.3(R/r)^2 + 0.7}{(R/r)^2 - 1} \quad (9)$$

wherein "δ" defines the radial deformation and "σ" defines the maximal stress in the membrane. The delivery quantity "Q" corresponds to the radial deformations multipled with the respective sectional areas. Note, that an additional delivery quantity "Q" appears by the axial alongation and contraction of the membrane portions multiplied by the respective cross sectional areas. The axial elongation (contraction) corresponds to Hooke's law with:

$$\Delta = \sigma L/E \quad (10)$$

The housing portions which hold end 1669 in FIG. 9 may be clamped together by bolts. Member 1671 is suitable to fasten end 1670 in cover 1 by tracting member 1671 in body 1 upwards by a nut on a thread.

Figure 10:
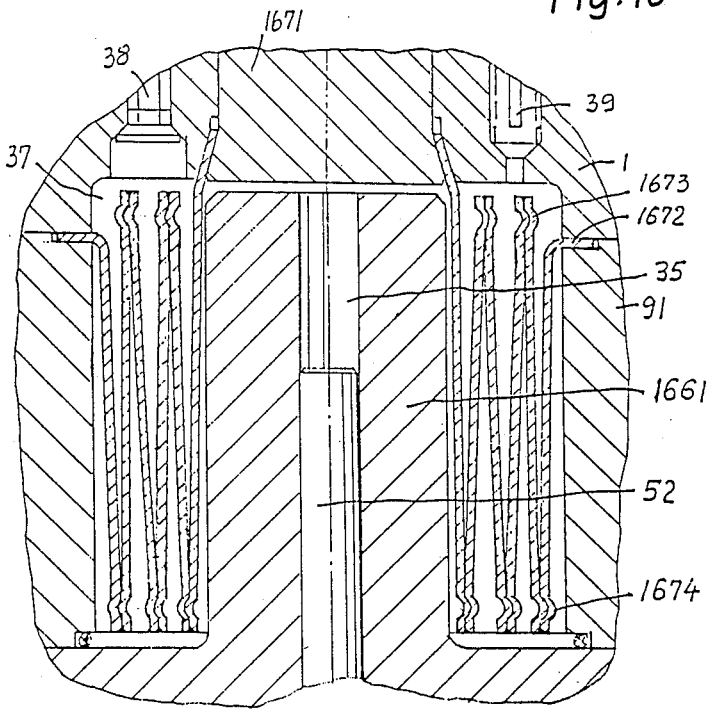

In the embodiment of FIG. 10 plural single pipe type membranes are fastened and sealed together on their axial ends by holding portions 1673 and 1674. Otherwise this figure corresponds substantially to the embodiment of FIG. 9.

Figure 11:
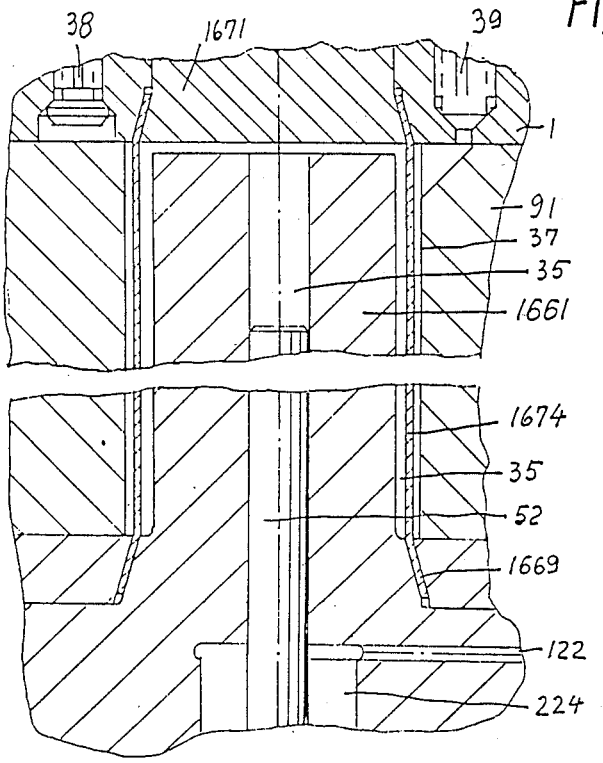

FIG. 11 illustrates in a longitudinal sectional view a most simple embodiment of the invention. A single pipe type membrane 1674 is with its axial ends fastened in portions and/or members of the pump. Such simple pipe portion may for medial pressures to be thrown away COCA COLA can of a single aluminium body. For higher pressure it is commonly made from stainless steel, if the non lubricating fluid in the second chamber 37 is water.

Figure 12:
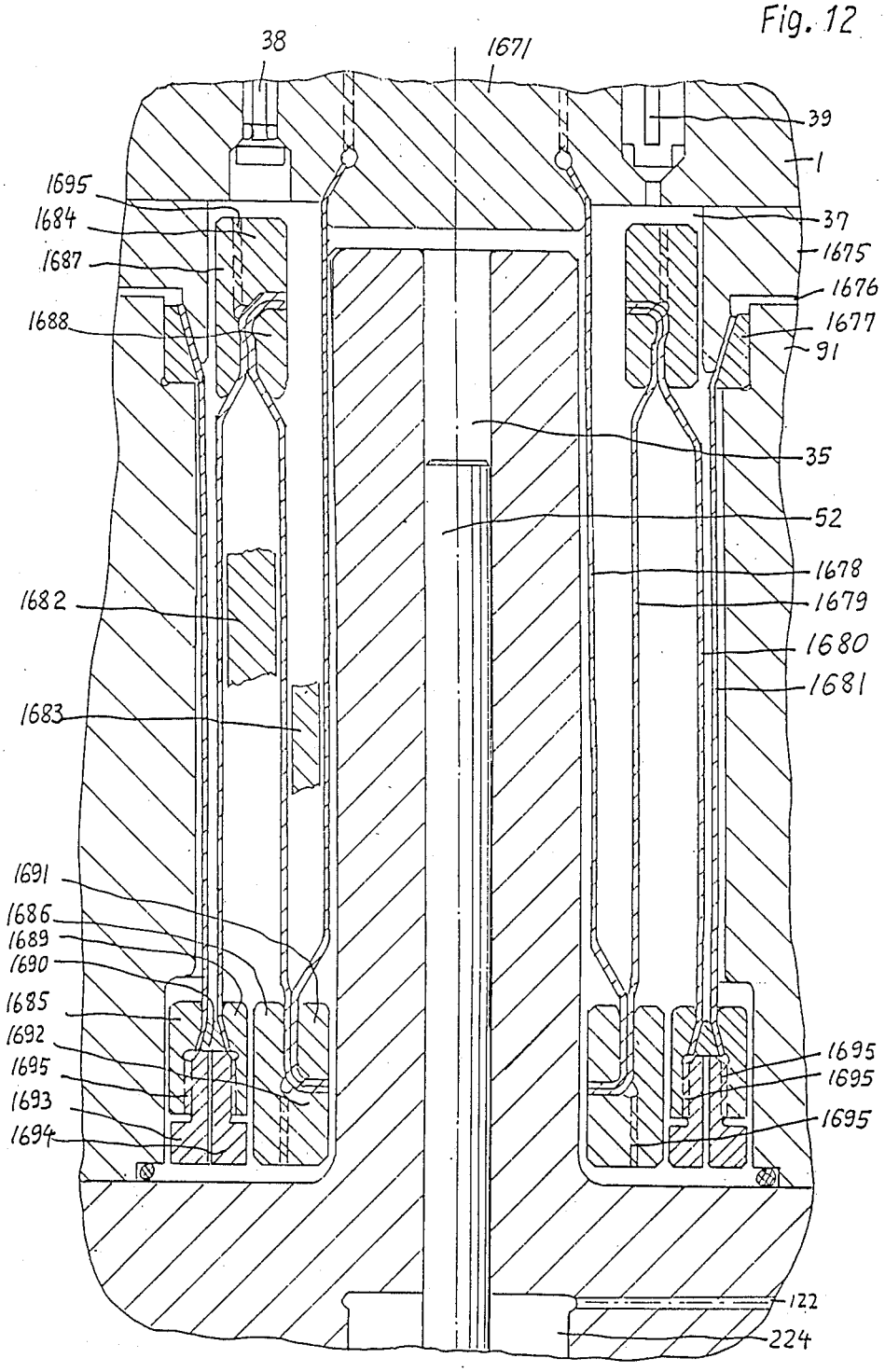

FIG. 12 illustrates an embodiment of the invention similar to that of FIG. 10. However, in FIG. 12 strong fastening members with threads are provided to fasten and seal the pipe portions of the membrane together. The pipe portions of the membrane are members 1678 to 1681, the fastening members are members 1685 to 1694 with threads 1695 on one axial end and with members 1684,1687 and 1688 on the other axial end. Members 1677 and 1675 clamp the final ends of the membrane onto the housing. 1676 is an axial space for the assembly of the tapered members 1675 and 1677 for a strong fastening of the end of membrane portion 1681. Since in this embodiment radial space is present between adjacent membrane pipe portions, respective dead space fillers 1682,1683 should be provided to obtain high efficiencies at high pressures in the fluids.

Since the delivery piston 52 are driven by a drive piston of bigger diameter, the cylinder 224 for the drive piston is provided with an unloading passage 122 on that cylinder portion which surrounds the portion of the piston 52 between its sealed portion and the drive piston.

Figure 13:
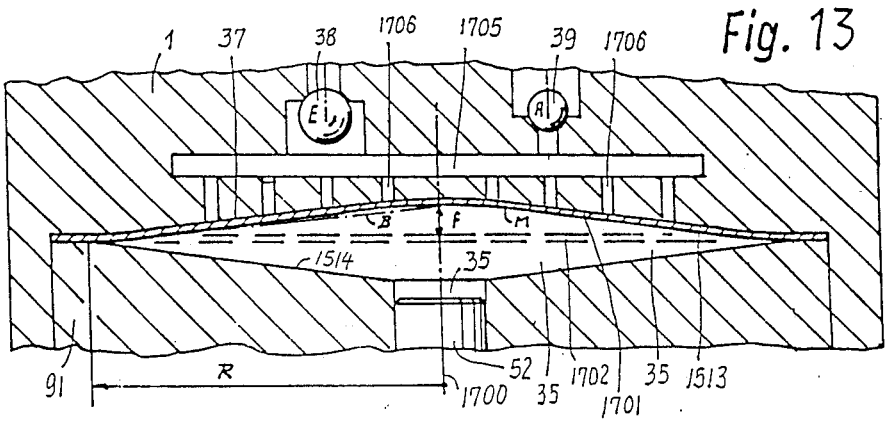

FIG. 13 illustrates the conclusion from the considerations of the invention, that a membrane for high pressure should not act freely between the chambers but be subjected to stroke limitation faces 1514,1513. The neutral position of the membrane is shown by the dotted lines 1702, while the deflected membrane after full upwards stroke is shown by 1701. Since from the earlier considerations in this patent specification it is known that the membrane must be thin, care should be taken that it can not become pressed into the cylinder or into entrance- and exit-ports. The entrance- and exit ports 38,39 therefore port into a collection chamber portion 1705 from which passages, which are formed by small diameter bores, 1706, extend into the pumping portion of the inner or second chamber 37. The diameters of the bores 1706 should not exceed the thickness of the membrane 1701 in order to prevent disturbance of the membrane at the very high pressures.

Figure 14:
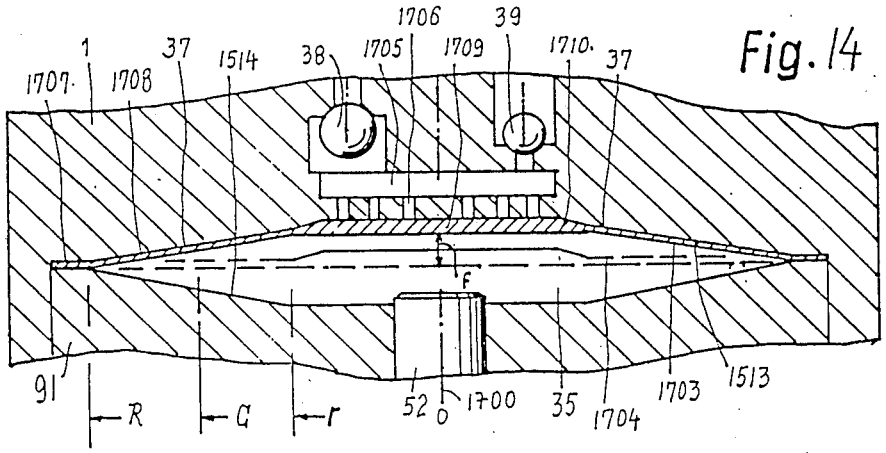

In FIG. 14 the aim of the invention is still more surely obtained. The breaking of the radial inner portion of the membrane is prevented by making the radial inner portion with a bigger thickness "t". This portion is illustrated by 1709. The axis of piston 52 is shown by 1700 (or by "0") and the bores 1706 in this embodiment are provided exclusively in the radial range of the thicker radial inner portion 1709 of the membrane.

Figure 15:
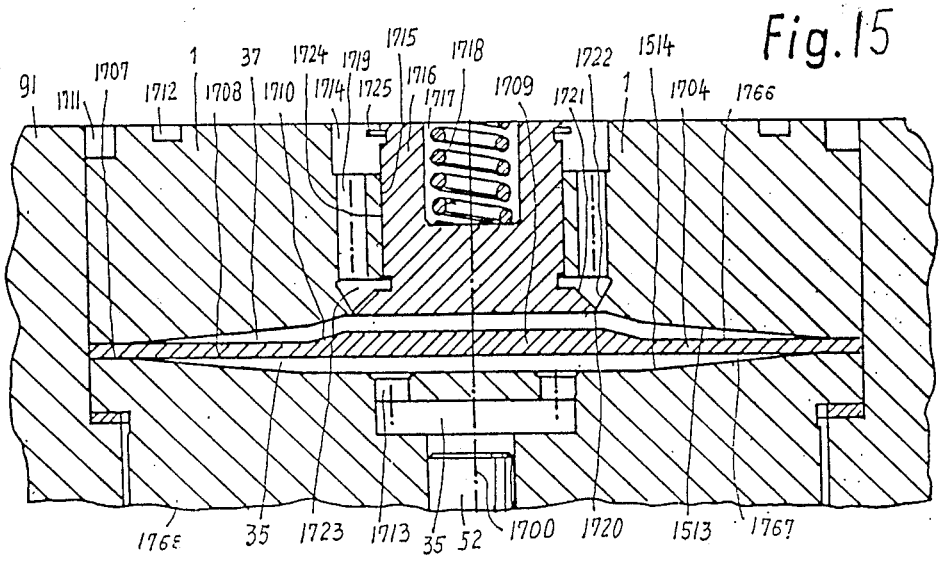

FIG. 15 illustrates the most safe embodiment of the invention for the prevention of disturbance of the membrane under high presures. At very high pressures the diameters of bores 1706 of the earlier Figures would have to be of such a small diameter, that they may fill with dirt and prevent flow of fluid or that their manufacturing (drilling) becomes too much time consuming and too expensive because too many bores of very small diameter would be required. This problem is overcome by the insertion of the axially stroking flow passage control valve 1716 of the invention. It is in this Figure provided in cover 1 while the outer chamber 35 is bordered by insert 1768 which contains the cylinder, the piston 52 and bore-passages 1713 of collection chamber portion 35. The entire arrangement may be provided in a cylindrical chamber portion of a pump with seal seats 1711,1712 towards the housing's head cover. Passage control valve 1716 is provided with a cylindrical outer face portion 1724 for axial reciprocal movement along the inner face 1715 of cylindrical and relatively fitting configuration. Spring 1718 in spring seat 1717 presses the flow control body downwards but the snap ring 1725 is provided to prevent an excessive extent of the stroke of the passage valve 1716. The passage valve 1716 has a front head face and a rear face. With its rear face it touches the upper housing's front face for prevention of excessive upwards movement. The passage valve 1716 is shown in its closing position, which is the uppermost location. The front face aligns with the bordering face 1513 of the inner chamber 37 at this position and location of the control valve whereby the control valve forms with its front head face a portion of the stroke restricting border face 1513. The front portion of valve 1716 has rearwards an inclined narrowing face and portion 1721 which is radially surrounded by a ring shaped annular space 1723, which space is formed into guide body 1 by the outwardly tapered face and portion 1722. From space 1723 extend substantially axially directed passages 1719 into the end space 1714.

Figure 16:
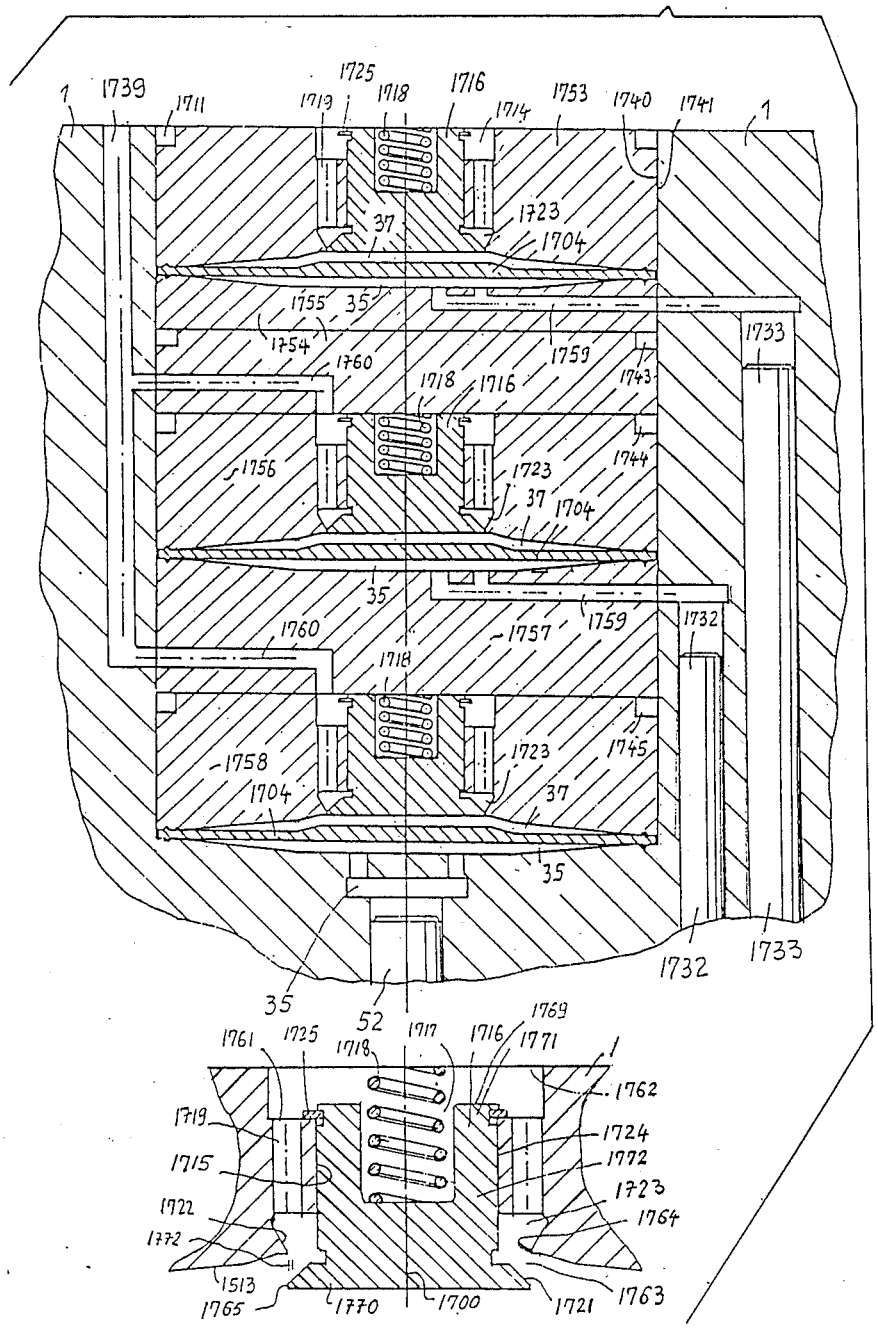

While in FIG. 15 the important passage control valve 1716 is shown in its closed position, the opened location of the passage control valve is seen in the bottom portion of FIG. 16. There the passage valve is moved downwards to its downwardsmost location at which the snap ring 1725 touches the bottom face 1761 of the rear space 1714. This touching prevents any further downwardly directed movement of the passage control valve 1716. It is seen in this Figure portion that the inclined face 1721 has now moved far away from the inclined face 1722 of the guiding body. A relatively wide annular gap 1763 is now opened between the passage control valve 1716 and the guide or cover 1. The fluid can now flow through the wide cross sectioned area of the passage 1763 from the entrance valve into the second or inner chamber 37 and in the opposed direction. When the second or non lubricating fluid flows through the passage 1763 (at the inlet stroke of the pump) into the inner chamber 37, the membrane moves downwards in its inlet stroke. The passage control valve 1716 follows this movement of the medial portion of the membrane but it is important here in accordance with the invention, that the stopper means 1725–1761 must be provided in such a style that the axial length of the stroke of the passage control valve 1716 remains shorter than the axial length of stroke of the radially medial portion of the membrane, in order, that the passage valve never meets the membrane. Because if the passage valve would meet the membrane, the membrane may become disturbed.

The passage valve 1716 becomes by it action and function a control valve for the size of the cross sectional area of the passage to the inner chamber (second chamber) 37. In this respect it is important by the present invention, to provide the cylindrical face 1764 on the guide or cover body 1 and to provide the cylindrical outer face 1765 on the front head of the passage control valve 1716. See hereto the bottom portion of FIG. 16. For high pressure the diameters of the faces 1764 and 1765 relative to each other are very important. Between them the radially narrow annular clearance 1772 appears. The radial extent of this clearance 1772 between the faces 1764 and 1765 shall for high pressure be shorter than the axial thickness of the membrane in order that no portion of the membrane can become pressed under high pressure into the annular clearance 1772. Comparing the closed position of the passage valve 1716 in FIG. 15 with its opened position in the bottom portion of FIG. 16, it is easily seen that passage 1763 has a big cross sectional area in the opened position of FIG. 16 while it has a very small cross sectionl area in the closed position of FIG. 15. In the closed position of FIG. 15 the cross sectional area corresponds radially seen to the difference of radii of the faces 1764 and 1765. This radial distance must be so short that it is shorter than the thickness "t" of the co operating membrane of the pump because otherwise the very high pressure in excess of thousand atmospheres would press a circular portion of the membrane into the clearance 1772 and that would lead to an early break of the membrane. In FIG. 15 the radially medial portion 1709 of membrane 1704 is still axially thickened relative to the radial outer portion of the membrane to prevent disturbance of the membrane at operation of the pump with high pressure. Since in practice it is difficult to treat the surfaces of a so configurated membrane, in the newer applications of the invention membranes of even thickness throughout the radial extension of the membrane are used. This obtains the invention thereby that the radial clearance 1772 between the faces 1764 and 1765 is made respectively short. For high pressure in excess of onethousand atmospheres the membranes commonly are made of strong metal with a thickness of 0.1 to 0.5 mm and the radial distance of gap 1772 between faces 1764 and 1765 is then 0.08 to 0.4 mm.

Figure 22:
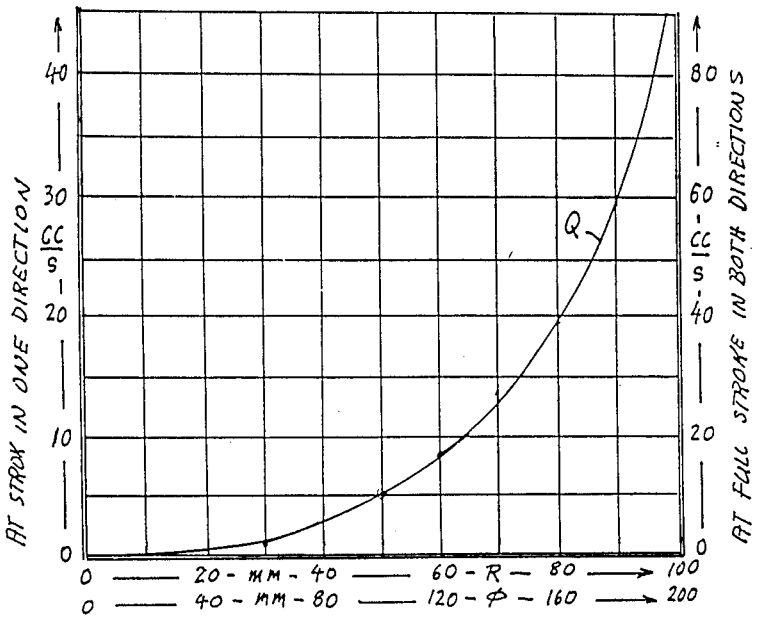

FIG. 22 shows a diagramm which brings the delivery quantity of a membrane of the invention over its diameter. This diagram shows that the delivery quantity of the membrane increases drasticly with its outer diameter. Such big diameters of membranes would lead to very large dimensioned and heavy pumps. Therefore, the invention also aims to built pumps or motors of small outer dimensions and of little weight.

Figure 17:
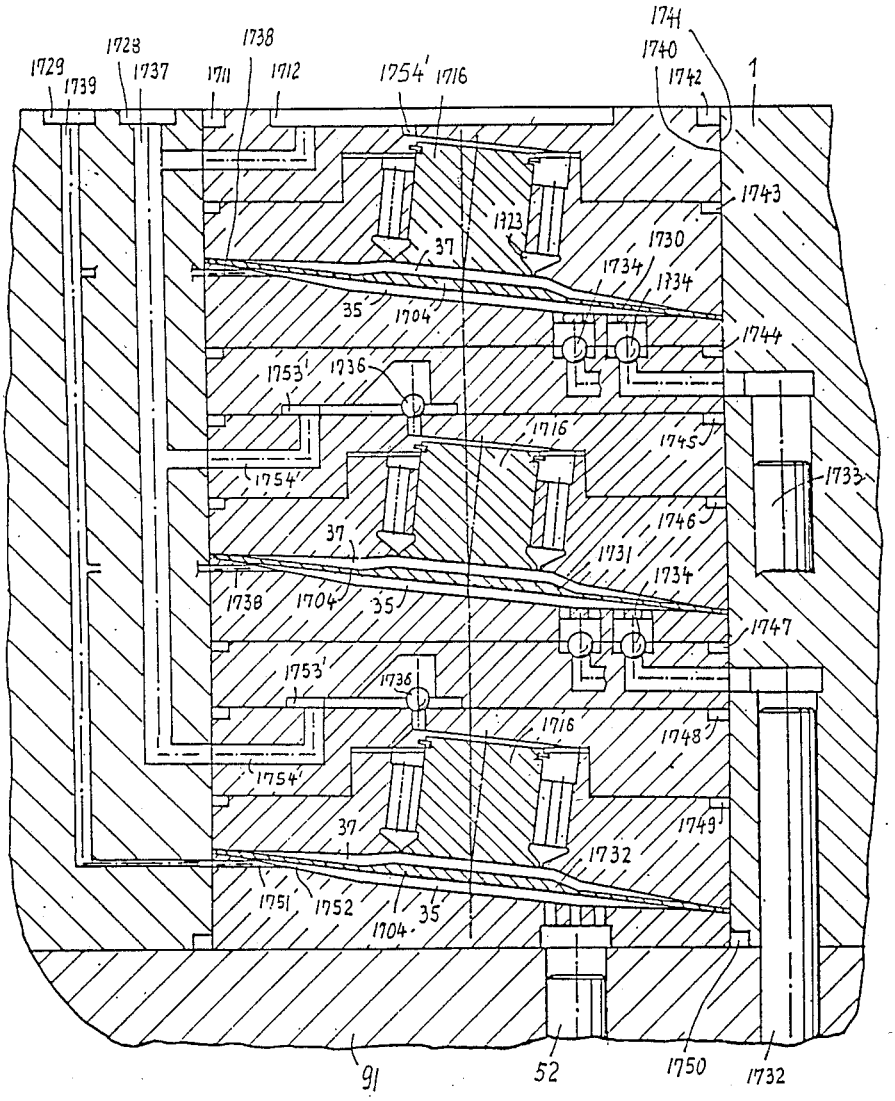

FIGS. 16 and 17 illustrate how pumps of small outer dimensions to obtain the mentioned additional aim and object of the invention, may be actually built. In these Figures a plurality of membranes are provided between a plurality of outer and inner (first and second) chambers 35 and 37 axially behind each other. Thereby all membranes of the assembly work—commonly at equal times—to deliver their individual delivery flows into a common delivery flow of fluid of higher delivery quantity.

Thus, in FIG. 16 a plurality of membranes 1704 are assembled axially of each other. The passage control valves are located in guide bodies 1753, 1756 and 1758 with these guide bodies also forming the stroke restriction faces for the delivery strokes of the membranes. The passages from the outer chambers 35 whereto the piston 52 is (or the pistons 52,1732, 1733 are) communicated, are shown by passages 1759 through body 1, 91 or inserted bodies 1754 and 1757. The several bodies must become sealed relatively against each other and that is accomplished by the provision of seal seats 1711,1743,1744, and 1745 whereinto respective plasticly deformable seals or seal rings may be assembled. If the bodies or some of them are mounted in a bore in body 1 or 91, the cylindrical outer faces 1741 of the respective bodies must have a very close fit on the inner face 1740 of the bore in order to prevent entering of portions of seal rings under the very high pressure into a clearance between cylindrical faces 1740 and 1741. Each inner chamber 37 (second chamber 37) is provided with a delivery passage 1760 through a respective guide body, for example, through bodies 1753,1756 and 1758. The individual delivery passages 1760 combine to the common delivery passage 1739 which leads to the exit valve 39 of the pump or of the respective chamber of the pump.

The herebefore discussed piston 52 may get a respective big diameter or a respective long stroke in order to serve all outer chambers 35 of the multi membrane assembly. But it is also possible to provide a plurality of individual reciprocating pistons 52,1732,1733 in respective cylinders to the respective individual first chambers 35. Such individual plural cylinders and pistons with respective passages 1759 to the outer chambers 35 have the feature that the dead space providing passages are than short and of relative small volume. Accordingly piston 1732 and its cylinder extend upwards only until the second outer chanber from the bottom while piston 1733 with its cylinder extends upwards until the topmost outer chamber 35. Piston 52 extends only into the neighborhood of the bottom most outer chamber 35 in order to obtain short passages 1759 for smaller dead space volume of passages in which the fluid would considerably compress at such high pressures and thereby reduce the efficiency of the pump. The arrangement thereby reduces or prevents much excessive dead space and therey improves the efficiency and reliability of the pump of the invention.

FIG. 17 illustrates a similar multi-chamber and multi-membrane arrangement as FIG. 16. In FIG. 17, however, the membranes are assembled slightly inclined under an angle of inclination. This is done to secure the expulsion of any air in the fluids. Respective air-out passages are set at the highest locations of the respective chambers and such air-out passages 1738,1751 are seen in this Figure. The air-out passages of the outer chambers 35 may combine to a common air-outflow passage 1739 which may lead to air-out port 1729. Respective closer means or valves of my earlier patent applications and publications may be provided to control the air out flow and close the passage at times when the air is completely out of the chambers. The air outflow from the inner chambers 37 is automatic by the provision of the outlet passages on the highest point of the inner chambers 37. In FIG. 17 are further individual inlet and outlet check valves 1734 and 1736 set to the individual outer and inner chambers 35 and 37. Respectively passages and ports 1753' and 1754' may be provided to secure a safe sealing of all bodies and passages relative to each other. Respective inbetween bodies are assembled in FIG. 17 for setting of valves 1734,1736 and of passages 1753',1754', while a respective number of seal seats 1742 to 1750 are then provided to the respective bodies.

FIGS. 18 to 21 deal with geometric measures and mathematical calculations for the stresses and deliveries of membranes and of membranes of the invention.

Very exact data for the stresses in the membranes and for their life times or number of strokes until breaking appears, are not known at this time. There has been an extensive research and testing on high pressure pumps at the inventor's licensed Japanese firms and at his research institute. For disc spring portions which are not radially inside and outside fastened, the following basic laws are considered:

$$\text{Hookes law: } \sigma = \frac{\Delta L}{L} E \tag{11}$$

and Eickmann equation:

$$\sigma = \left[\left(\frac{\frac{1}{\cos\phi} - 1}{1}\right)\Delta R \pm \frac{t}{2}\sin\phi\right]\frac{E}{0.91\,\phi} \tag{12}$$

There are many RER reports of the inventors research institute which deal with geometric-mathematic details and they are so extensive that they can not be repeated in this application. The calculation methods for disc springs can be applied without specific consideration to membranes, because the membranes are fastened radially on their radial outer ends between the housing 91 and cover 1 or between respective bodies. The membranes except that of FIG. 4, have no medial bores, they are a circular plate but not a ring.

On the other hand, the invention uses stroke restriction faces 1513 and 1514 on the respective bodies to define exact axial ends of the inner and outer chambers and to force the membranes to come to a stop of their strokes when the membranes meet these stroke restriction faces 1513 or 1514. The stroke restriction faces of the invention thereby restrict the strokes of the membranes and force the membranes in accordance with the present invention to obtain at their maximal strokes, at the ends of their strokes, specific locations and configurations of the invention. For these specific locations and configurations Hookes law and the mentioned Eickmann equations (2) or (12) may apply. Very exact are the equations for the calculation of the delivery quantity of the membranes. Presently not absolutely exact are the calculations for the stresses inside of the membranes, since the exact dimensions of radii "r" whereof radially inside the membranes of the invention shall be radially flat, is presently not exactly known. The range of best "r" is, however, already now very narrow because of the many calculations and considerations in the RER reports of the inventor and because of the testing of the many different membranes in the test stands and in actually built pumps.

Figure 21:
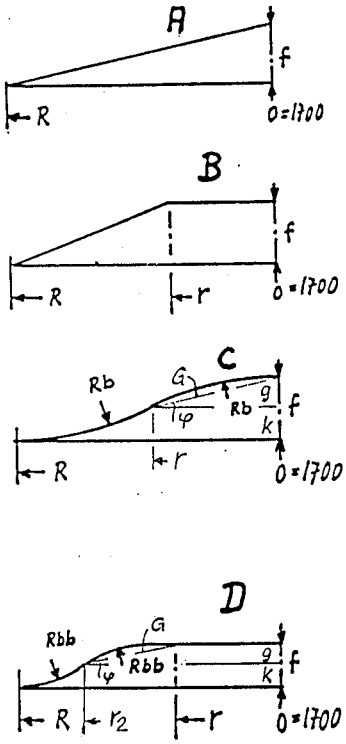

The considerations of the invention lead to the impression that an optimum of life time and delivery quantity would be obtained by the membrane of the cross sectional configuration of FIG. 21-D. The outer portion (radial outer paortion) would be formed by two opposed radii "Rbb" which meet in about the radial middle between radii "R" and "r". It is therefore desired to obtain an ability to calculate such radius "Rbb".

Figure 19:
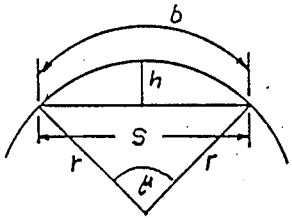

FIG. 19 shows the geometrical concepts of the circle which are available from the standard literature of mathematics and geometries. The sectors, lengths of archs "b" etc. can be calculated, if the radius "r" is known. But, having a membrane of the cross sectional configuration of FIG. 21-D, the radius "Rbb" can not be calculated from the known mathematics because there remain all times two unknown values.

Figure 20:
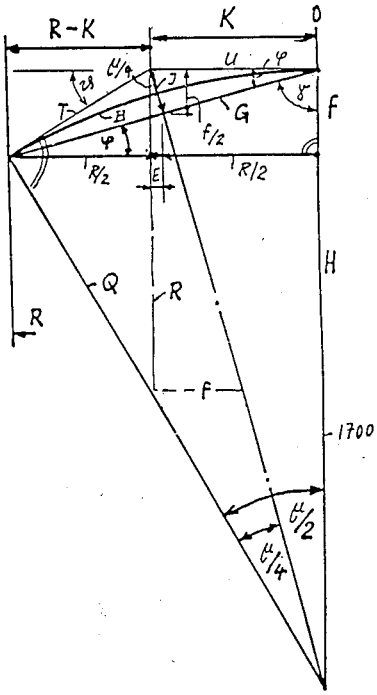

FIG. 20 illustrates how the inventor has solved this mathematical problem. Arch "B" becomes according to this invention divided between intervall sectional angle "$\mu$" of FIG. 19 into one half with angle "$\mu/2$". This section becomes devided again into two sectors of angle "$\mu/4$". Then the relationships of FIG. 20 appear. There appear similar triangles with equal angles. As a result thereof the radius "Q" in FIG. 20 can become calculated and it will hereafter get the name "$\rho$". The equation, obtained by the inventor, for "rho" now is:

$$\rho = (R - r/2)/\sin(24) \tag{13}$$

With this important equation established, all other values of FIG. 20 can now become calculated. They are provided by the respective RER-reports.

FIG. 21 compares the delivery quantity of differently configurated membranes of equal stroke and outer diameter. The delivery quantities of figure portions 21-A and 21-B can be calculated by equation (1). Figure portion 21-C is assumed to be one of the membranes of the prior art. Figure portion 21-D is one of the membranes of the present invention. How to calculate the delivery quantities of the two last mentioned membrane configurations are given again in the respective RER reports and in European patent publications of the inventor. A comparison brings, that the delivery quantity of type 21-B very highly exceeds the delivery quantity of type 21-A anfd type 21-D of the invention highly exceeds the delivery quantity of the membrane of type 21-C. Type 21-D of the invention exceeds the delivery quantity of type 21-C of the prior art as more as bigger the radius "r" becomes in relation to radius "R". The membrane of the invention of type 21-D may deliver up to 70 precent more fluid than the membrane of the type of FIG. 21-C (which is assumed to be the membrane of the prior art). To deliver at equal size until percent more fluid delivery quantity is obviously a considerable success of the present invention.

FIG. 22 illustrates the delivery quantities of membranes of the invention of FIG. 21-D over the outer diameter of the effective stroke of the membrane.

Figure 23:
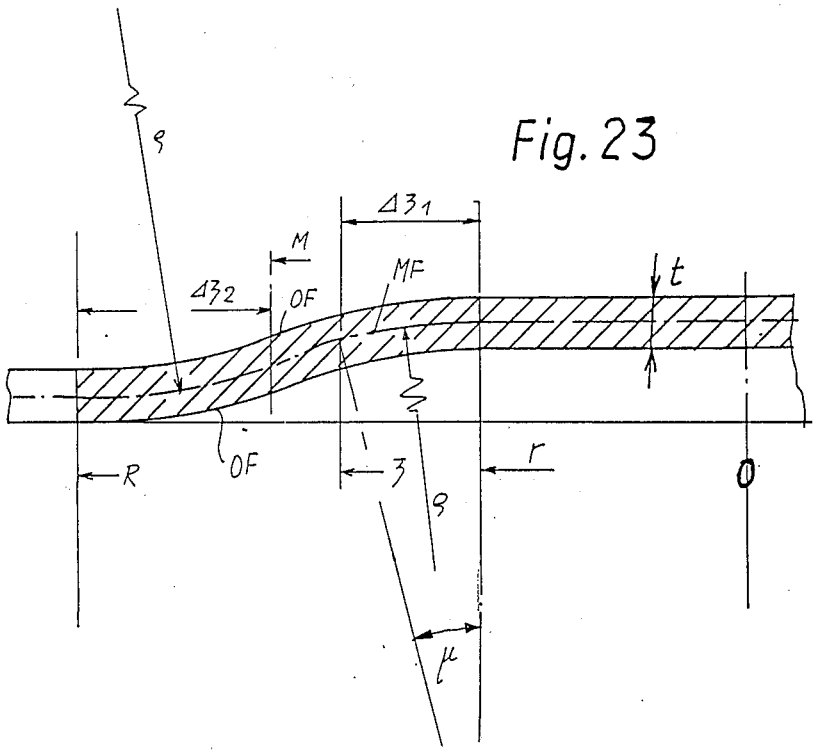

FIG. 23 illustrates a cross section through one radial half of the membrane of the invention of FIG. 21-D.

Therein the radius "ξ" is introduced. ("ξ"=the japanese hirkana character for "ro".) Using now angle "μ" with sin $\mu=\Delta\xi/\rho$ brings a possibility to calculate all local stresses of the membrane with equation (12). The following table brings samples fo several membranes of the type 21-D of the invention, as far as they are presently used and applied, with therein indice "1" for radially inside of "ξ" indice "2" for radially outside of radius "ξ". "L" stands for the radial deformation, "σ" stands for stresses, "MF" stands for the medial neutral layer which obtains only radial elongation or contraction, while "OF" stands for the axial outer layer which obtains additional radial elongations or contractions due to the thickness "t" of the membrane. Note that this table gives a good impression about the relative stresses due to radial elongation compared to those due to thickness "t" and vice versa.

TABLE 3

| R mm | r mm | f mm | t mm | 3 mm | $\phi$ o | $\rho$ mm | R − 3 mm | 3 − r mm | $\mu_1$ o | $\mu_2$ o | $\Delta LMF_1$ mm | $\sigma_{MF1}$ kg/mm$^2$ | $\left(\frac{t}{2}\right)\sin\phi_1$ mm | $\sigma_{OF1}$ kg/mm$^2$ | $\Sigma\sigma_1$ kg/mm$^2$ | $\Delta LMF_2$ mm | $\sigma_{MF2}$ kg/mm$^2$ | $\left(\frac{t}{2}\right)\sin\phi_2$ mm | $\sigma_{OF2}$ kg/mm$^2$ | $\Sigma\sigma_2$ kg/mm$^2$ |
|---|---|---|---|---|---|---|---|---|---|---|---|---|---|---|---|---|---|---|---|---|
| 30 | 12 | .6 | .3 | 21 | 1.91 | 135.15 | 9 | 9 | 3.82 | 3.82 | .0067 | 17.1 | .067 | 25.6 | 42.7 | .0067 | 17.1 | .067 | 25.61 | 42.7 |
| 40 | 16 | .8 | .3 | 28 | 1.91 | 180.2 | 12 | 12 | 3.81 | 3.81 | .0089 | 17.1 | .067 | 19.2 | 36.3 | | | | | |
| 50 | 20 | 1.2 | .3 | 35 | 2.29 | 187.8 | 15 | 15 | 4.58 | 4.58 | .016 | 24.6 | .080 | 18.4 | 43.0 | | | | | |
| 50 | 20 | 1 | .3 | 45 | 1.91 | 225.25 | 5 | 25 | 1.27 | | .0004 | 1.89 | .022 | 15.4 | 17.26 | | | | | |
| " | " | " | " | 40 | " | " | 10 | 20 | 2.54 | | .0033 | 7.58 | .044 | 15.4 | 22.95 | | | | | |
| " | " | " | " | 35 | " | " | 15 | 15 | 3.82 | 3.82 | .0111 | 17.1 | .066 | 15.4 | 32.46 | .0111 | 17.1 | .067 | 15.4 | 32.46 |
| " | " | " | " | 30 | " | " | 20 | 10 | | 2.54 | | | | | | .0033 | 7.58 | .044 | 15.4 | 22.95 |
| " | " | " | " | 25 | " | " | 25 | 5 | | 1.27 | | | | | | .0004 | 1.89 | .022 | 15.4 | 17.26 |
| " | " | 1.2 | " | 35 | 2.29 | 188 | 15 | 15 | 4.58 | 4.58 | 0.16 | 24.6 | .080 | 18.4 | 43.04 | | | | | |
| " | " | 1.4 | " | " | 2.67 | 161 | " | " | 5.34 | 5.34 | .022 | 33.5 | .093 | 21.5 | 54.98 | | | | | |
| " | " | 1.6 | " | " | 3.05 | 141 | " | " | 6.11 | 6.11 | .028 | 43.7 | .106 | 24.5 | 68.28 | | | | | |
| " | " | 1 | .2 | " | 1.91 | 225.25 | " | " | 3.82 | 3.82 | .0111 | 17.1 | .0667 | 10.24 | 27.34 | | | | | |
| " | " | " | .3 | " | " | " | " | " | " | " | " | " | " | 15.37 | 32.46 | | | | | |
| " | " | " | .4 | " | " | " | " | " | " | " | " | " | " | 20.49 | 37.58 | | | | | |
| " | " | " | .5 | " | " | " | " | " | " | " | " | " | " | 25.61 | 42.70 | | | | | |
| 100 | 40 | 2.6 | .4 | 70 | 2.48 | 347 | 30 | 30 | 4.96 | 4.96 | .0735 | 28.9 | .0173 | 13.31 | 42.19 | | | | | |

The flattening (evening) or thickening of the radial inner portion radially inwards of radius "r" of the membrane of the invention is provided to prevent the break of the membrane in its radial center. The invention assumes that the flattened medial portion inside of radius "r" provides a strength against radial expansion and thereby prevents the breaking of the membrane in its radial center. Note that this is an important improvement, done by the present invention, relative to the earlier breaking membranes of the prior art.

Figure 18:
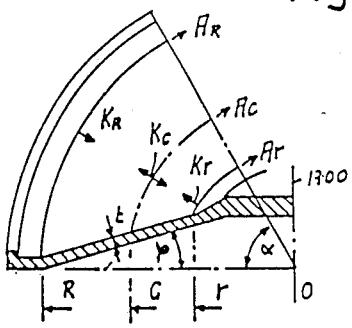

In FIG. 18 a section of a membrane is shown schematically. It illustrates the cross sectional areas and stresses at different radii of the membrane. The respective sectional areas are:

$$A_r=2r\pi t \quad Ae=2c\pi t;\ A_R=2R\pi t \tag{14}$$

and the respective forces are:

$$K_r=\sigma_r Ar;\ K_c=\sigma_c A_c;\ K_R=\sigma_R A_R \tag{15}$$

Equalizing the forces, yields:

$$K_c=K_R=K_r \tag{16}$$

and:

$$\sigma_c 2\pi t=\sigma_r 2R\pi t=\sigma_r 2r\pi t \tag{17}$$

and:

$$\sigma_c C=\sigma_R R=\sigma_r r \tag{18}$$

wherefrom follows:

$$\sigma_R=Cv_{c/R} \text{ or } \sigma r=C\sigma_{c/r} \tag{19}$$

This leads to the present assumption that for a first estimate of the life time of the membrane a single estimating equation (20) can bring an impression about the life time of a membrane. If the membrane is loaded with less than about $\frac{1}{3}$ of its maximal permissible stress, the membrane may obtain a life in excess of 30 million strokes and thereby be fit for use in a pump with good life time.

This single equation would be:

$$\frac{R-C}{r}\left[\left(\frac{\frac{1}{\cos\phi}-1}{1}\right)(R-C)\pm\frac{t}{2}\sin\phi\right]1.0989\ E/r \tag{20}$$

and thereby similar to equations (2), or (12).

Therein the factor $$\left(\frac{\frac{1}{\cos\phi}-1}{1}\right) \tag{21}$$

is a neutral factor which gives the elongation of the media layer of the membrane if multiplied with the radial distance. Value (t/2 sine) helps to define the stresses in the outer layer due to thicknesses "t".

In FIG. 22 the delivery quantity "Q" is shown in cubiccentimeter per stroke, defined by: "CC/S". The left scale gives the quantity "Q" if the membrane strokes only from the neutral flat portion in one of the axial directions. In the devices of the invention it is mostly used for full strokes between the boundary—stroke restriction faces 1513 and 1514. Then the right side scale for full strokes applies.

From FIG. 23 and the last defined table, table 3, it appears that the highest stresses appear at radius "M" equal to "(R+r/2" where "Δξ" 1 and 2 are equal.

It is to be noted here again, that no full accuracy is claimed for the calculations which determine the stresses. But the equations have a great practical value for the design of the membrane pumps or motors of the invention. Because technologies can not advance if it has to be waited until at a much later time a good mathematician will develop perfectly accurate equations. Compromises have to be made to find the most delivery providing membrane for a long life and reliability. That is obtained by the present invention and by its equations in a close approximacy. As but also the stresses increase then. The present compromise is to let "r" be about fourty precent of "R". Then there is enough space to maintain the passage control valve in the medial flat portion of the membrane and the then appearing medial radius "M" of the radial outer portion then corresponds almost to the equation:

$$\xi=\sqrt{(R^2+r^2)/2}. \tag{22}$$

This equation was developed by the inventor by setting the cross sectional areas equal over the radial extension of the flat circular sheet by setting $$\int 2\xi\pi t d\xi/\xi^R=\int 2\xi\pi t d\xi/r^3 \tag{23}$$

whereupon the integration brought the above equation (22).

Equal cross sectional areas at all radii in the circular membrane would bring a radial cross sectional configuration of a taper with the thinnest thickness at outer radius "R" and the maximum of thickness at the center of the membrane at radius "O". But such membrane might be too expensive in production, since extremely good surface treatment and evenness of the density inside of the material of the membrane is required, if the membrane shall hold for a long useful life time.

FIG. 23 explains the location of the medial layer "MF", of the outer layers "OF", of the radii "O", "r", "ro". "M" and "R" as well as the radii "rho" and the angle "my". This Figure thereby provides the geometrical basis for some of the equations and for table 3.

Figure 24:
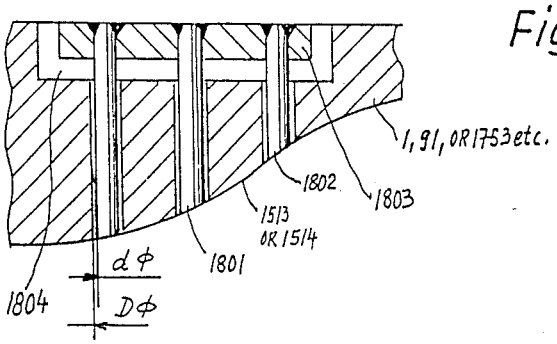

FIG. 24 illustrates an alternative for the small diameter bores 1509 of FIG. 1 and 1706 of FIG. 14 as well as for the passage control valve 1716 of FIG. 15. For pumps which have no space for the passage control valve 1716 or for which the control valve 1716 is too expensive, the embodiment of FIG. 24 of the invention may be applied. The body 1,91,1753 or the like is provided with bores of diameter "D". Cylindrical bars 1801 or 1802 are inserted with diameters "d" into the mentioned bores with diameter "D". Thereby a circular clearance appears around the bars between "D" and "d". Since bores can be drilled or reamed for exact diameters and bars can be grinded also very exact, it is inexpensive and geometrically easy to secure very narrow clearances between diameters "D" and "d". They can radially be easily shorter than the thickness "t" of the membrane is. The membrane can then never enter into the mentioned clearance and the membrane can consequently not become disturbed. The fluid flows then through the mentioned clearances. A flow collection chamber 1804 may be provided on the rear ends of the bores and the bars 1801, 1802 may be fastened or welded in a body portion 1803. The stroke restriction face 1513 or 1514 may then be machined at the same machining process with body 1, 91 etc. with at the same time machining the inner ends of the bars 1801 etc. in order to obtain a perfectly configurated face 1513 or 1514 consisting of portions of body 1,91 etc. and the inner ends of bars 1801,1802 etc.. Such arrangements may also be used for flow control and other supply or exit matters.

Figure 25:
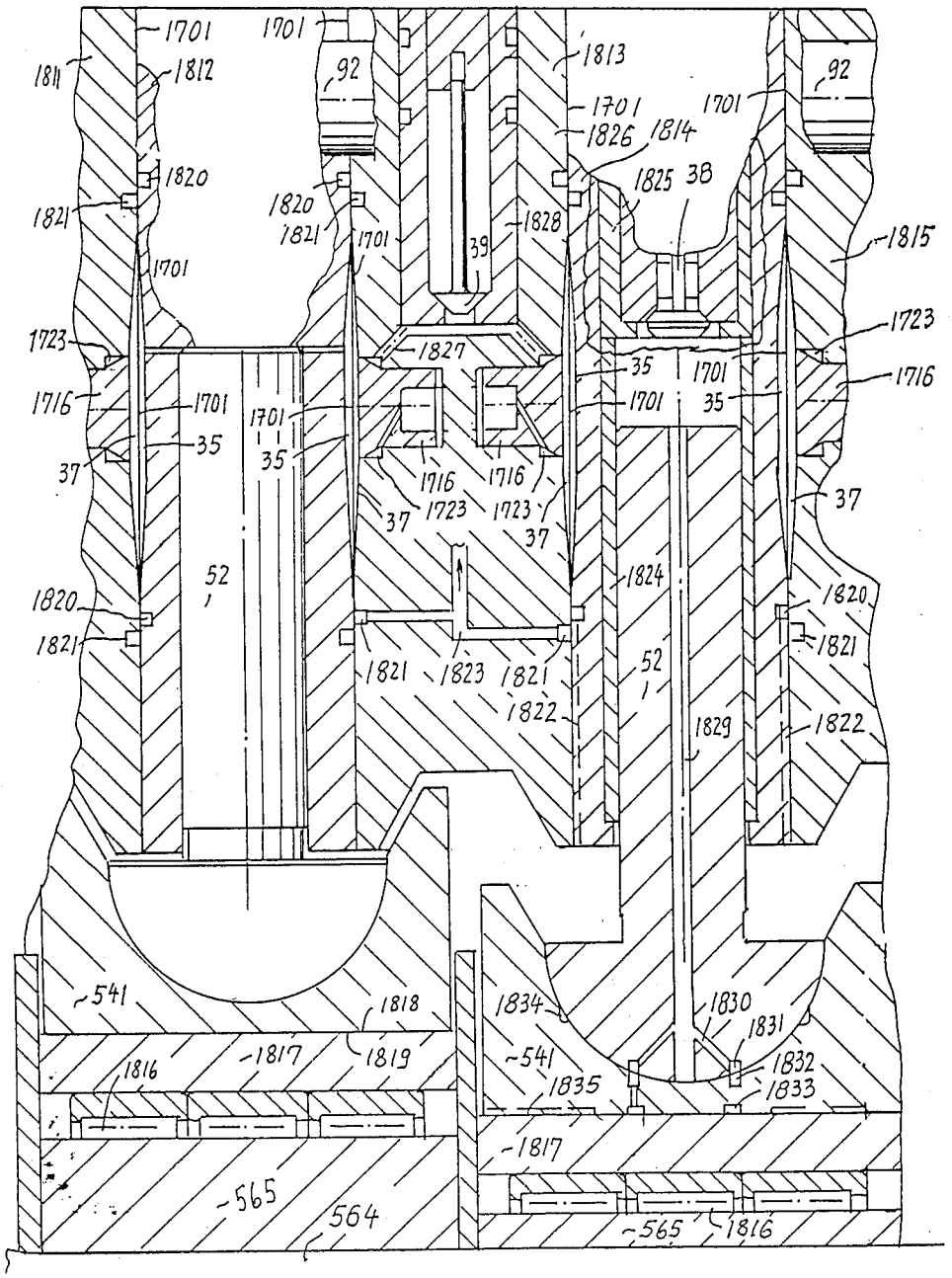

FIG. 25 illustrates in a sectional view of a preferred embodiment of the invention for very high delivery quantity of a high pressure membrane pump. It can also be used as a compressor or as a low pressure pump. The specific feature of this embodiment of the invention is that it exists of a plurality of plane plates and membranes, where each of these plates serves a plurality of functions. Either it contains a cylinder with piston 52 reciprocatable therein and fluid supply of the single piston 52 into a plurality of outer chambers before membranes. Such plates are shown by plates 1811 and 1813. Or the plate has the plural function to receive the fluid from at least two individual inner chambers 37 of neighboring membrane pumps. These plates are shown by plates 1811,1813 and 1815.

Between two neighboring plates is each one membrane 1701 provided and the plates are strongly fastened together axially of each other by, for example, fasteners like bolts 92 with respective nuts or engagement into threads. While plasticly deformable seals may be provided to the individual membranes 1701. In FIG. 25 such plasticly deformable seals are spared. The sealing of the inner and outer chambers is established by the pressing together of the plates and membranes. For safety of maintenance of separation of the two different fluids in case of failure of the pressing sealing, unloading recesses 1820 are provided for the collection of leakage fluid from the outer chambers, while unloading recesses 1821 are provided for the collection of leakage from the inner chambers 37. Recesses 1820 may be communicated by passages 1822 to the interior of the housing of the pump for mixing with the lubricating fluid inside of the housing. Recesses 1821 may be communicated by passages 1823 to the water reservoir or to ther nonlubricating fluid reservoir of the pump.

The left piston 52 in plate 1812 pumps into both, the left and right, outer chambers 35 of plate 1812. Similarly the right side piston in plate 1814 pumps into the left and right outer chambers 35 in plate 1814. The fluid flow handling plates 1811,1813 and 1815 contain each a right and left side inner chamber 37, a right side and left side passage control valve 1716 to the respective inner chamber 37, inlet and exit passages 1827 and either single inlet- and exit-valves 38, 39 or plural inlet- and exit-valves 38 and 39. Thus, the second or non lubricating fluid from the membranes sidewards fo left piston 52 pumps into plates 1811 and 1813, while piston 52 of plate 1814 effects the delivery of the non lubricating fluid into plates 1813 and 1815. Between breaking lines in plate 1814 is an inlet valve 38 indicated, which actually is located peripherally of valves 39 in plates 1811, 1813. Outlet valves 39 and inlet valves 38 may be contained in cartridge inserts 1828 or 1825, respectively. For use of steel plates, the bronze bushes or bushes of good sliding providing materials, shown by 1824, may be inserted into the plates to surround and seal the respective pistons. The pistons 52 may be reciprocated by an inclined revolving swash plate or by stroke guide faces 1818 of eccentricly revolving rings 1817. Shaft 564 may carry a plurality of cams with eccentric outer faces to bear or run thereon roller (or needle) bearings (antifriction bearings) 1816 which in turn permit the revolution of the stroke guide rings 1817. Piston shoes 541 may be provided between the pistons 52 and the stroke guide faces 1818 with the slide faces 1819 of the piston shoes then sliding along the stroke guide faces 1818. By revolving the shaft 564 the eccentric stroke guide faces 1818 provide together with the pre-pressure in the outer chambers the reciprocal pumping movement of the pistons 52.

The right side piston 52 illustrates that the fluid from outer chamber 35 extends through passage 1828 longitudinally through piston 52 to fill with the respective pressure in this fluid the fluid pressure groove 1831 (circular groove) on the bottom of the piston head. This pressure is also passed through the passage below annular groove 1831, supplied by 1830, into the annular grooves 1832 and 1833 of the piston shoe. Thereby hydrostatc bearings are formed between the piston and shoe as well as between the piston shoe and the piston stroke guide of guide ring 1817. Such hydrostatic bearings are no novelty, but generally used in the older Eickmann patents. Novel, and an embodiment of the invention, however, is, to make such arrangements suitable for use at pressures which exceed one thousand atmospheres. That is obtained by the combination of a radius of the piston's head about two or more times larger than the radius of the outer face of the piston 52, by limiting the outer diameter of grooves 1831 to 1833 to less than 10 percent larger than the diameter of pistons 52 and by limiting the pivotal movement of the piston shoe relative to the piston to less than 15 degrees (sum of both directional swings), but for very high pressure by limiting the angle of the inclined swash plate or of the eccentric cam to five degrees or only slightly larger degrees. For good efficiencies in pumps and motors high angles of pivotion for long piston strokes are generally desired. But that is not easily workable for high pressures of several thousand atmospheres or in excess of one thousand atmospheres of pressure. Extremely accurate machining and lapping of the faces with equal radii of piston head and piston shoe is urgently required for such high pressures. A number of lubrication recesses 1834,1835 must be provided in the bearing land radially outwards of the annular recesses 1831 to 1833.

Figure 26:
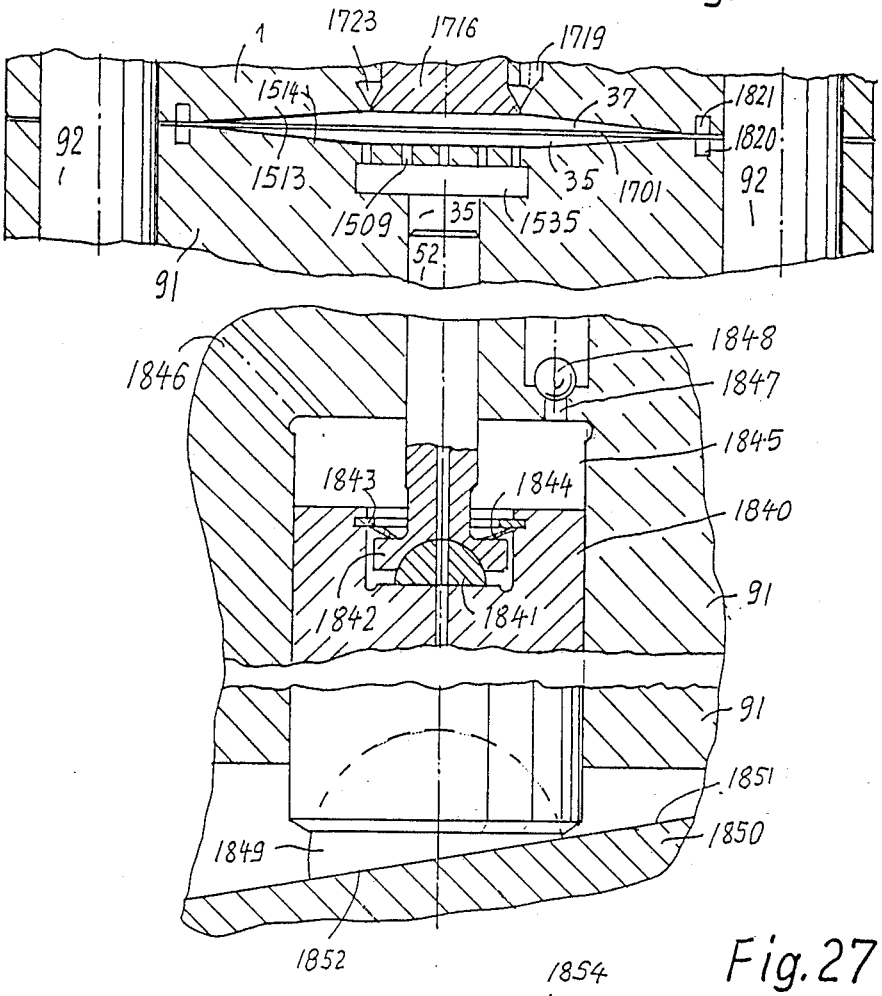

If for extremely high pressures the arrangement to the right piston 52 of FIG. 25 is not reliably working or if the pre pressure in the outer chamber does not press the pistons 52 fast enough outwards, the arrangement of FIG. 26 is very helpful.

In FIG. 26 another preferred embodiment of the invention is illustrated. It has head body 1 and housing 91 provided with planer end faces. Therebetween the membrane 1701 is provided and the arrangement is strongly torque together by bolts 92. The leakage collection grooves 1820 and 1821 are provided as known from FIG. 25. The membrane may have an outer diameter for almost meeting the closest portions of outer faces of bolts 92. Thereby the membrane 1701 centers itself at assembly into the correct location. Head cover 1 contains the inner chamber 37 and the passage control valve 1716 as well as the inlet and outlet valves 38 and 39 (not shown in FIG. 26). Housing 91 contains the outer chamber 35, the cylinder as portion of chamber 35 and the piston 52 reciprocating in the cylinder. It then occurs occasionally that for very high pressures the piston 52 is so closely fitting in the cylinder and of such a small outer diameter that the relatively low pre pressure in the outer chamber is unable to press piston 52 fast enough downwards for the inlet stroke. Then the drive piston 1840 of bigger diameter is provided in a cylinder 1845 and the pump piston 52 is fastened to the drive piston 1840 for equal strokes. The connection of the mentioned both pistons with radial adjustability is established by the half ball 1841 between the pistons with the holding of the radially widened portion 1842 of piston 52 by disc spring 1844 and snap ring 1843 in drive piston 1840. The piston shoe 1849 is borne in the pivot bed in the bottom end of drive piston 1840 and slides with its slide face 1852 along the piston stroke guide face 1851 of the inclined swash plate 1850 which acts as piston stroke guide member during its rotation around the axis of the drive shaft. The pre-pressure control fluid of the outer chamber may then be led during the outwards stroke of the pistons through passage 1846 into the wider cylinder 1845 to act on the wider cross sectional area of the drive piston to drive piston 1840 downwards while piston 1840 then also tracts piston 52 downwards. The pre pressure fluid which enters cylinder 1845 through passage 1846 then passes from cylinder 1845 through one way valve 1848 in passage 1847 to and into the outer chamber 35. At the fluid delivery stroke the pressure in the outer chamber 35 increases to the pressure exceeding onethousand atmospheres and closes the one way valve 1848 to prevent entering of fluid from the outer chamber into cylinder 1845.

Piston shoe 1849 then acts under medial pressure and its reliablity during operation can be easily obtained and maintained.

Figure 27:
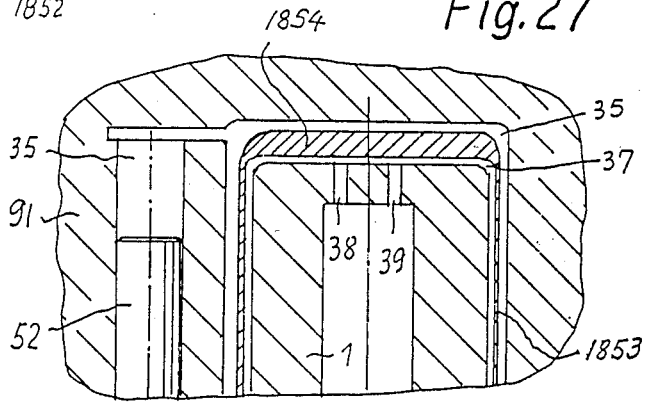

FIG. 27 illustrates the reversal of FIG. 11. Instead of providing the outer chamber radially inside of the pipe-type membrane, the outer chamber is in FIG. 27 provided radially outside of the membrane 1853. The piston 52 is also provided radially outside of membrane 1853. The inner chamber 37 is provided radially inside of membrane 1853 and body 1 extends into the space radially inside of membrane 1853 to contain the inlet and outlet valves 38 and 39 (indicated by lead lines, but not actually illustrated in this Figure since known from earlier Figures). The membrane 1853 is provided with a bigger top-portion 1854 to prevent entering of portions of the membrane into bores, valves or inlet and outlet passages 38,39. The feature of this arrangement is, that at pumping stroke the membrane 1853 is not subjected to expansion as in the earlier Figures, but to compression. Compression leads not so easy to break of bodies as excessive expansion does and the arrangement of FIG. 27 thereby promises a longer life time of membrane 1853. The provision of top portion 1854, making the membrane to a "cup-type membrane", spares the fastening of a second end of the membrane onto a respective body 1 or 91.

Viewing FIGS. 16 and 25, it may be understood that the plural flat plates or rings of FIG. 25 may also be provided in FIG. 16 or 17. While in FIG. 25 the pistons extend radially they extend axially in FIGS. 16 and 17. Thus, if the plates or rings 1811 to 1815 would be provided in the assemblies of FIG. 16 or 17, the pistons 52 would not be provided radially in plates 1812 and 1814 but would extend perpendicular relative to the radial extension of the plates or rings and plates or rings 1812 and 1814 would then instead of cylinders and piston contain passages from the respective cylinders to both respective first or outer chambers 15. To prevent compression in fluid suffering dead space volume in such passages, therein oscilating bodies of uncompressible material may be assembled.

The invention is still further in detail described in the claims and the claims are therefore considered to be a portion of the description of the preferred embodiments.

As far as no total assemblies of pumps have been illustrated in this application, they are in detail described in the parental patent applications, which are mentioned on page 3 of this present application.

What is claimed is:

1. A pump, comprising, in combination a first body 1 with at least one inlet valve, at least one outlet valve and an inner chamber 37, a second body 91 with a piston reciprocable in a cylinder with said cylinder communicated to an outer chamber 35 in said second body and a chamber separation member between said bodies and said chambers, wherein said separating member is a radially planar ring 1520 with an inner radius "r" and an outer radius "R", wherein said ring has a radial inner portion radially inwards of its medial portion and a radial outer portion radially outwards of said medial portion, wherein said first and second bodies form radial planar axial end faces, wherein said end faces are distanced from each other by a distance ring 1537 of a first axial thickness, wherein said radially planar ring has a second axial thickness, wherein said second axial thickness is slightly shorter than said first thickness, wherein seal beds are provided in said end faces and flexible seal rings 1538 and 1529 are inserted into said seal beds, wherein said radial outer portion of said radially planer ring is inserted between said end faces and radially inwards of said distance ring with a clearance 1522 formed between said outer radius "R" and the inner diameter of said distance ring 1537, wherein said radial outer portion extends radially outwardly beyond said seal beds and said seal rings, wherein said radial inner portion of said radially planer ring is subjected to closing of the inner bore of said radially planer ring by an interior closing device, wherein said interior closing device is formed by two rings 1523 and 1524 with an inner distance ring 1530 between them with an axial thickness equal to said first thickness, wherein seal beds with therein provided elasticly deformable seal rings 1526 and 1527, are formed in said two rings, wherein said radial inner portion of said radial planar ring 1520 is inserted between said two rings, wherein a clearance 1521 is formed between the radial inner diameter "r" of said radially planar ring and the outer diameter of said inner distance ring, and, wherein the radial inner portions of said two rings are clamped together by an inner ring 1525 which forms clamping portions 1531 which axially and radially partially embrance said inner portions of said two rings.

2. The pump of claim 1, wherein an air-outlet passage 1516 is ported to said inner.chamber 37.

3. The pump of claim 1, wherein an air-outlet passage 1517 is ported to said outer chamber 35.

4. The pump of claim 1, wherein an inner chamber portion 1533 is formed in said first body for the temporary reception of a portion of said interior closing device.

5. The pump of claim 1, wherein an outer chamber portion 1535 is formed in said second body for the temporary reception of a portion of said interior closing device.

6. The pump of claim 1, wherein the difference between said distances is smaller than 0.1 mm and the axial thickness of said seal rings during uncompressed condition is bigger than the axial depth of said seal beds.

* * * * *